United States Patent [19]

Brown et al.

[11] Patent Number: 5,067,296

[45] Date of Patent: Nov. 26, 1991

[54] MODULAR INSULATED WALL PANEL SYSTEM

[75] Inventors: Robert T. K. Brown, 66 East Beach Road, Bowmanville, Ontario, Canada, L1C 3K3; Ronald W. Smith, 37 Parkway Crescent, Bowmanville, Ontario, Canada, L1C 1B9

[73] Assignees: Robert T. K. Brown; Ronald W. Smith, both of Bowmanville; Patrick W. Olive, Unionville, all of Canada

[21] Appl. No.: 377,584

[22] Filed: Jul. 10, 1989

[51] Int. Cl.[5] ..... E04C 1/00

[52] U.S. Cl. ..... 52/309.7; 52/285; 52/295; 52/481; 52/592; 52/806

[58] Field of Search ..... 52/309.9, 309.11, 346, 52/481, 285, 286, 589, 265, 90, 295, 515, 778, 806, 592, 309.7

[56] References Cited

U.S. PATENT DOCUMENTS

| | | | |
|---|---|---|---|
| 2,568,133 | 9/1951 | Swisher, Sr. et al. | 52/285 X |
| 3,195,698 | 7/1965 | Codrea | 52/239 X |
| 3,353,315 | 11/1967 | Barker | 52/309.11 X |
| 3,363,378 | 1/1968 | Palfey | 52/376 X |
| 4,112,646 | 9/1978 | Clelland | 52/372 |
| 4,471,591 | 9/1984 | Jamison | 52/309.9 |
| 4,671,032 | 6/1987 | Reynolds | 52/309.9 X |

FOREIGN PATENT DOCUMENTS

| | | | |
|---|---|---|---|
| 551432 | 5/1977 | U.S.S.R. | 52/309.11 |

OTHER PUBLICATIONS

Gillespie, Countryman, Blomquist, *Adhesives in Building*, Feb. 1978, pp. 12, 32–33.

*Primary Examiner*—Richard E. Chilcot, Jr.
*Assistant Examiner*—Linda J. Watson
*Attorney, Agent, or Firm*—Neil H. Hughes; Ivor M. Hughes

[57] ABSTRACT

A panel having two ends and two sides, the panel having a peripheral frame and having at the sides thereof a first surface and a second surface separated by a predetermined distance. The predetermined distance extending from end to end of the panel. The panel has non opposing studs located proximate the first and second surfaces and separated by a predetermined distance. The studs of the first surface are offset or staggered laterally a predetermined distance from the studs proximate the second surface. Insulation having two ends and two sides is located proximate the surfaces extending within the peripheral frame between the first and second surfaces with the studs embedded in the surfaces. The insulation extends to each end of the panel, whereby the panel is rigidified by the lateral staggering of the studs. A joint proximate each end of the panel is supplied for interconnecting adjacent panels. The joint comprises some of the insulating means and some of the frame, wherein the side of the stud member extends a predetermined distance beyond the end of the insulation to form a stepped interlocking joint with the joint extending from top to bottom of each panel and ends thereof.

14 Claims, 4 Drawing Sheets

FIG.2.
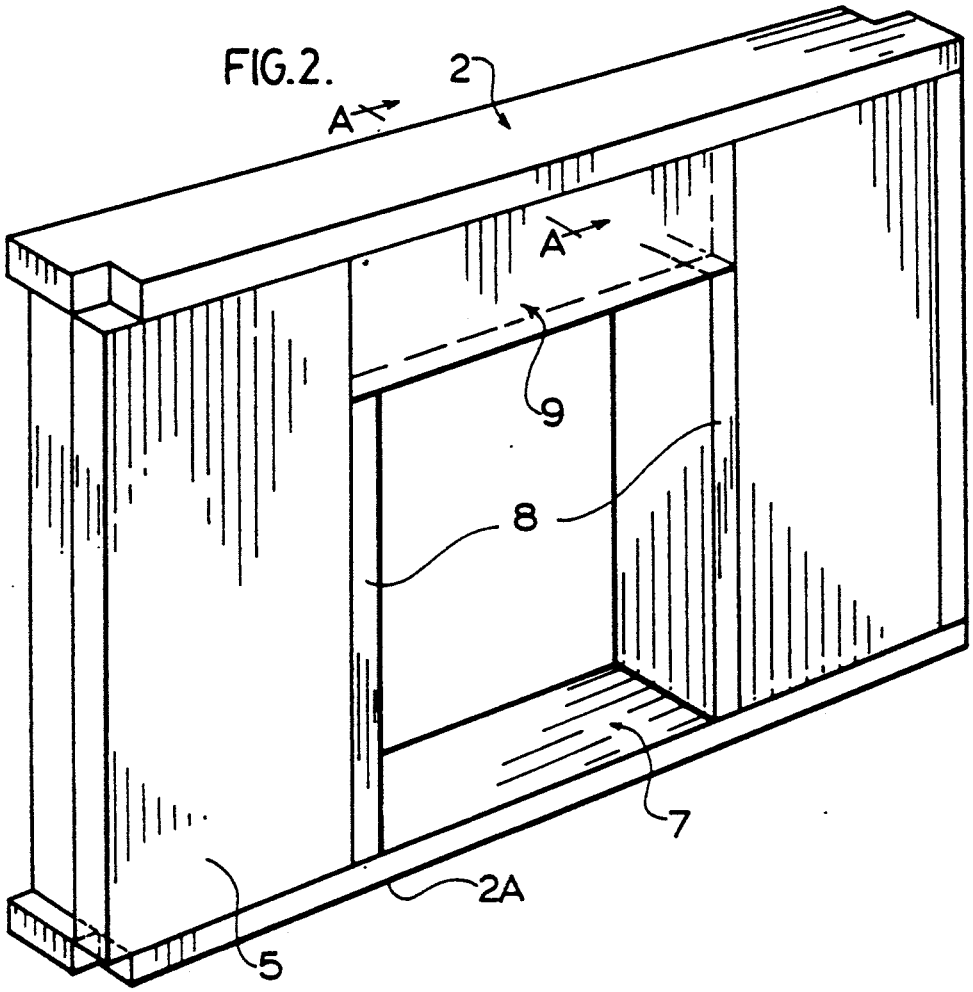
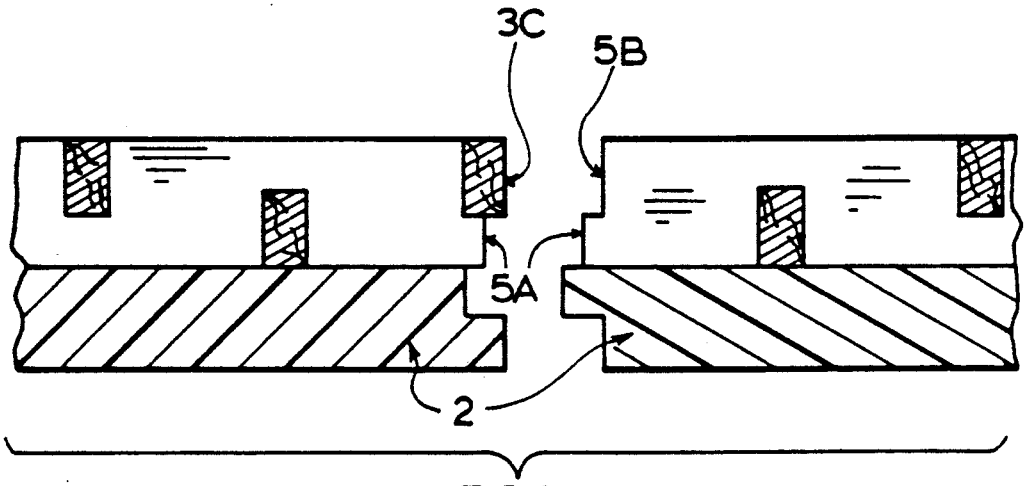
FIG.4.

12
4
5F
5E
5D
5C
6
14
13
14

FIG.5.
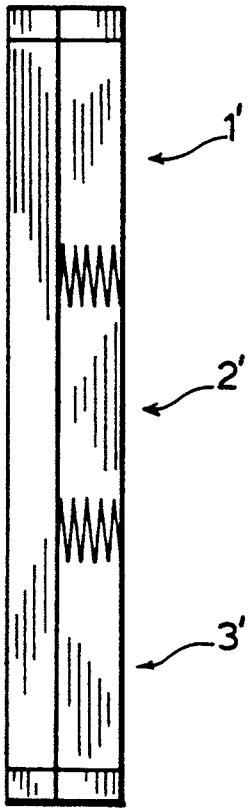
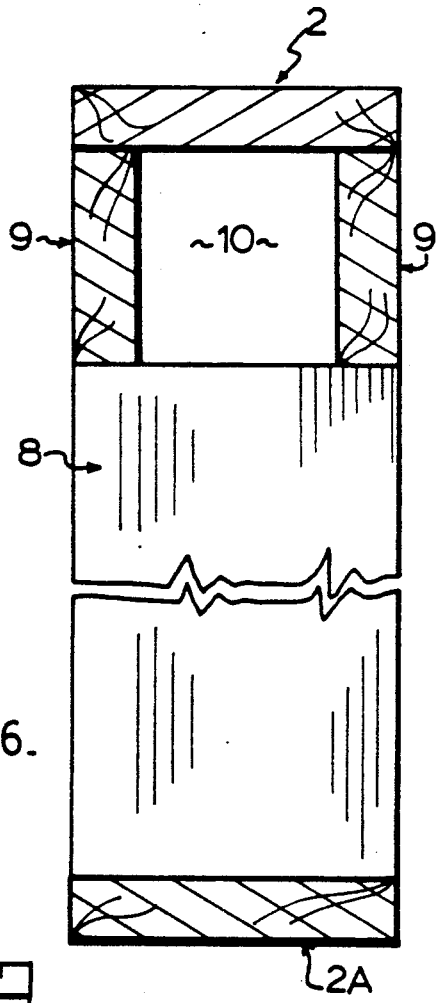
FIG.6.
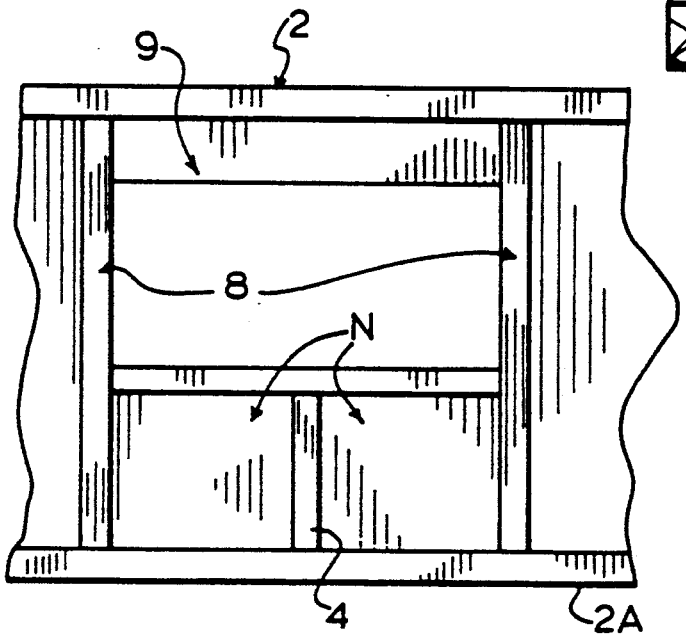
FIG.7.

MODULAR INSULATED WALL PANEL SYSTEM

FIELD OF INVENTION

This invention relates to a modular insulated panel system for use in the construction of buildings or the like where said panel provides a continuously insulated structure.

BACKGROUND OF THE INVENTION

Modular panels are know in the art. Specific examples are found in Canadian letters Patent 1,169,625 issued to Jack Slater on 84/06/26; 1,116,371 issued to Karl R. Linton on 82/01/19; 1,047,730 issued to Adrien Berloty on 79/02/26; 705,580 issued to Charles A. McElhone on 65/03/16 and U.S. Pat. No. 4,112,646 issued to John J. Clelland on 77/02/14.

Canadian Letters Patent 705,580 discloses a "sandwich" type of structure of two panels and a frame containing a foamed polymeric core.

Canadian Letters Patent 1,047,730 discloses a panel element comprising a frame enclosing an insulating foam, with rectilinear thin strips members being flush with the insulating foam, on one side, and a supporting vertical member being flush with the foam on the other side of the panel element.

Canadian Letters Patent 1,116,371 discloses an insulated wall panel with rectilinear members on both sides of the wall panel where each pair of members are mechanically joined through the insulation. The panels are connected to each other, by placing and insert in a groove provided therefore, located at the ends of the panels, so as to form a plurality of interconnected panels.

Canadian Letters Patent 1,169,625 discloses a wall panel comprising a foam core with framing members being surface bonded directly to the foam and the framing members are flush with the foam. The joint system used to interconnect the panels consists of the tongue of one foam member (positioned between the framing members) being in contact with the tongue of another frame member so as to have both tongues positioned between the framing members, that are surface bonded to the foam as shown in the patent.

U.S. Pat. No. 4,112,646 disclosed a precast insulated wall structure having a concrete core with slabs of foam between parallel vertical framing members where the positioning of the framing members on one side of the wall are staggered in relation to the framing members of the other side of the wall.

The object of this invention is to provide a panel when connected to another panel forms a true continuous insulating core regardless of positioning of the ends of the panels (i.e. corner joints, straight joints). Further objects of the invention will be apparent from the following specification, claims and drawings.

SUMMARY OF THE INVENTION

The invention according to one embodiment comprises a panel, having two ends and two sides, the panel having a peripheral frame and having at the sides thereof a first surface and a second surface separated by a predetermined distance, the predetermined distance extending from end to end of the panel; the panel having studs located non opposing proximate the first and second surfaces separated by a predetermined distance, said studs of said first surface being offset or staggered laterally a predetermined distance from said studs proximate said second surface; and insulating means having two ends and two sides located proximate the surfaces extending within the peripheral frame between the first and second surfaces with the studs embedded in the surfaces; said insulating means extending to each end of the panel, whereby the panel is rigidified by the laterally staggering of the studs.

Another embodiment of the invention may further comprise a panel with a joint means proximate each end of the panel for interconnecting adjacent panels comprising some of the insulating means and some of the frame; wherein the side of said stud member extends a predetermined distance beyond the end of the insulating means to form a joint stepped interlocking the joint extending from top to bottom of each panel and ends thereof.

A preferred embodiment of the invention may further comprise the panel with insulating means wherein the staggered studs are embedded in the first and second surfaces of said insulating means.

Yet still another preferred embodiment of the invention may comprise a panel having upper and lower frame members and proximate the end of the upper and lower frame members one side of the frame member extends a predetermined distance beyond the opposite side of said frame member forming a recess, whereby abutting ends of interconnected panels engage to form a true fit.

Yet still another preferred embodiment may further comprise a panel wherein the studs are a composite of at least two members with grain directions of each member being substantially angled to one another, and said members being interlocked.

A preferred embodiment may further comprise the members being interlocked via a finger joint.

Even yet, another preferred embodiment may further comprise a panel system of at least two panels, engaged end to end whereby the end portions of the insulating means are engaged such that a continuous insulating barrier is provided resulting in a tortuous path to the elements.

Yet still another preferred embodiment may further comprise joint means being a double stepped interlocking joint.

Yet still another preferred embodiment may further comprise a panel where said insulating means comprises a foam portion.

Yet still another preferred embodiment may further comprise a panel where said recess located proximate the ends of said panels is in the form of an "L".

BRIEF DESCRIPTION OF THE DRAWINGS

The invention will now be illustrated with respect to the following drawings illustrating embodiments of the invention in which:

FIG. 2 is a perspective view of a panel unit with a provision for a doorway or the like.

FIG. 4 is a top view of a side joint whence connected.

FIG. 5 is an end view of FIG. 1 showing the finger jointed stud.

FIG. 6 is a cross sectional view of FIG. 2 taken in the direction 6—6.

FIG. 7 is a front view of a panel unit with provision for a window or the like.

DETAILED DESCRIPTION OF PREFERRED EMBODIMENTS OF THE INVENTION

Figure 1:
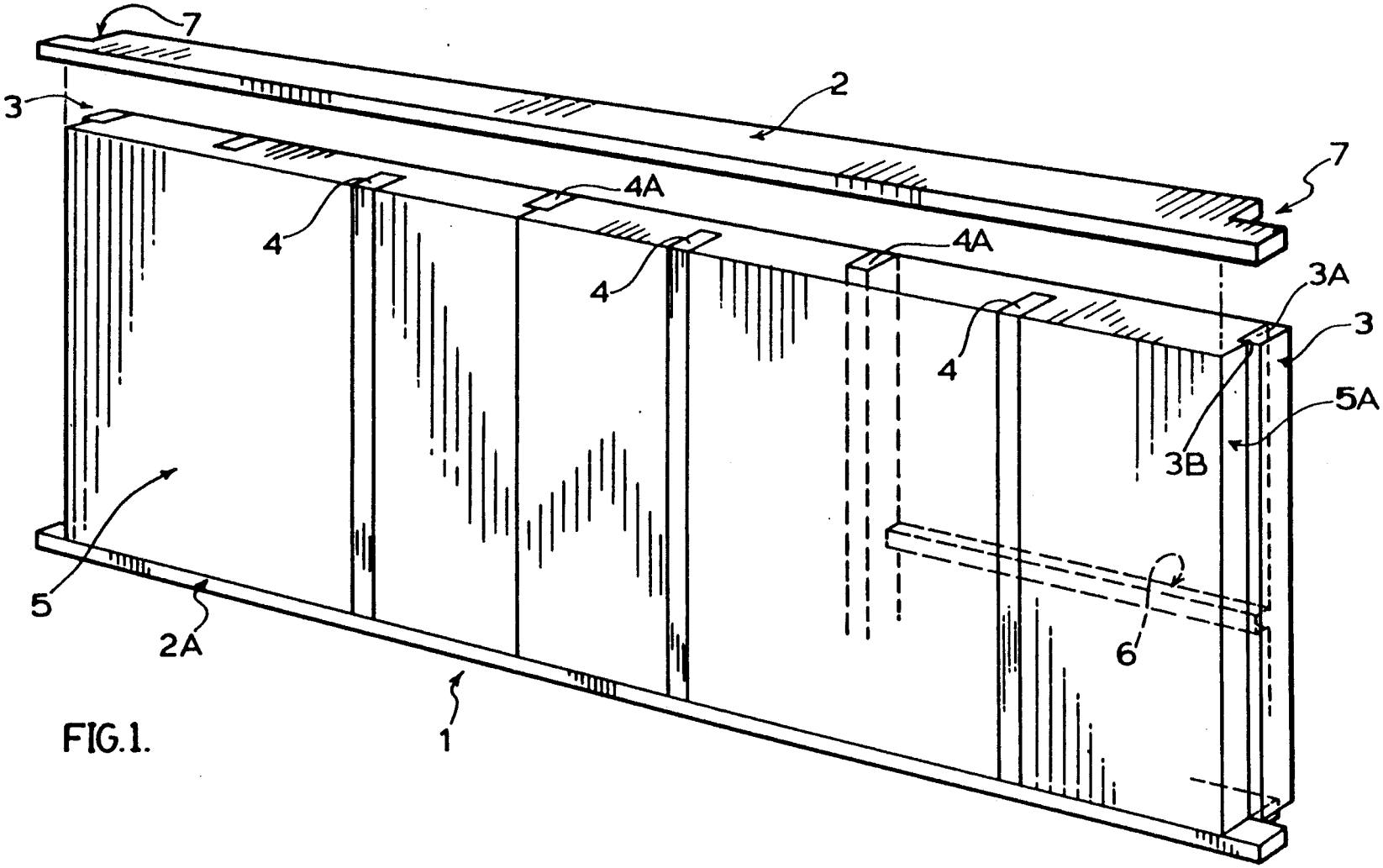
FIG. 1 is a perspective view of a panel unit.

Referring to FIG. 1, the panel (1) comprises an upper (2) and lower (2A) frame member and end members (3) which separate the upper (2) and lower (2A) frame members a predetermined distance and also form the peripheral frame of the panel (1). On one surface of the panel (1) are stud members (4) running vertically and flush with the upper (2) and lower (2A) frame members. On the other surface of the panel (1) are stud members (4A) running vertically and flush with their respective panel (1) surface.

The stud members(4A) on one surface are staggered a predetermined distance from the stud members (4) on the other surface.

The panel (1) has at least one foam block (5) encased by a peripheral frame made up of an upper (2) and lower (2A) frame member and two end portions (3). The foam block (5) is made a predetermined shape so as to allow the friction fit of the stud members (4–4A) within the vertical channels of the foam block (5) thus not requiring any adhesive to hold the stud in place. Once inserted into place, the foam block(5) and the stud members (4–4A) are flush. Also provided for running of electrical wiring or other utility line is a groove (6) positioned preferably parallel to the upper (2) or lower (2A) frame members.

The end portions (5A) of the foam block (5) in the interior side (3A) of end member (3) stops, to leave some of the stud side (3A) of the stud member (3) exposed, to allow a proper junction to be made. Similarly, the end portions of upper (2) and lower (2A) frame members, preferable an "L" shaped area (7) covers preferably half the distance of the upper portion (3A) of end members (3) to allow a proper junction to be made.

Referring now to FIGS. 2 and 6, the panel (1) is now formed for a door way (12) where two elongated stud members (8) run vertically to form the sides of the door frame support and wherein two elongated members (9) run horizontally and the portions proximate the ends of the horizontal members (9) are fixed to the portion proximate the upper end of the vertical members. The space (10) formed by the elongated horizontal members (9) and the upper (2) frame members is filled with foam also.

Referring now to FIG. 7, a panel unit with the provision for a window (13) is shown. The structure differs from the door panel in that an insulated portion (11) is constructed from the lower (2A) frame member but still following the general characteristics of the invention (i.e. staggered stud embedded in the foam block).

Referring now to FIG. 4, a side joint is formed by bringing together one end of a panel with the end of another panel. With the upper frame member (2) moved to the side, a better understanding of the joint is seen. The end portion of panel (1) is brought together with the end portion of another panel so as to bring surface (5A) of one panel (1) in contact with the surface (5A) of the other panel (1). Consequently surface (5B) of panel is brought in intimate contact with surface (3C) of one member (3). At this point, all end surfaces of foam block (5) is in intimate contact with end member (3), except for surfaces (5A) that are in intimate contact with each other. Similar upper (2) and lower (2A) frame members are joined in an exact but reverse manner as to the foam blocks (5),termed a double ship lap joint.

Figure 3:
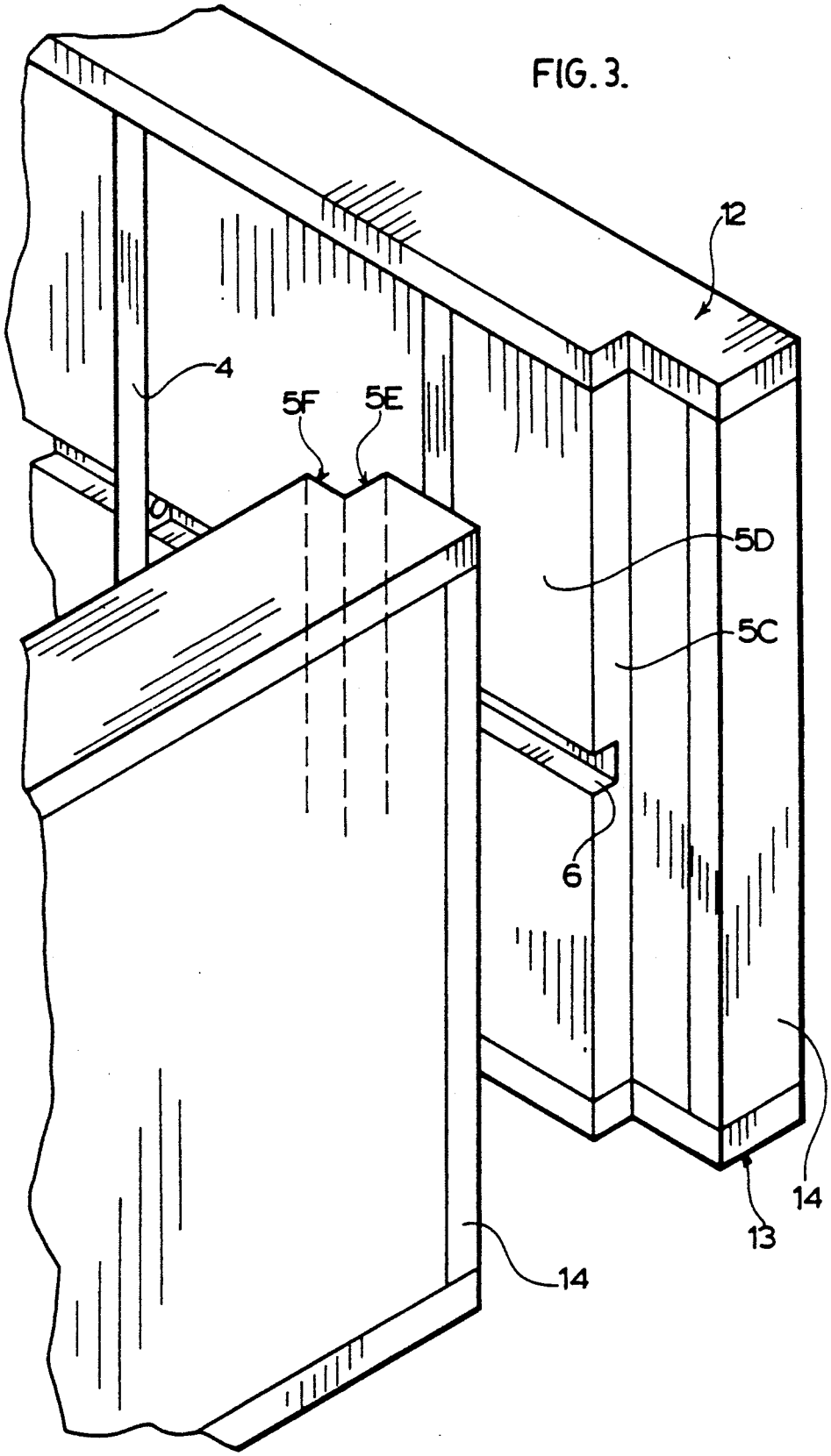
FIG. 3 is a perspective view of a corner joint prior to connection.

Referring now to FIG. 3, a corner joint is seen just prior to unification.

The corner units are slightly modified from the straight wall units characterized by the upper (12) and lower (13) frame members being flush with the end portion of the foam block (5) and the vertical end member (14).

Both joints are unified so as to level itself on the foundation of the building. When both units are unified, surfaces 5C and 5D are intimately contacted with surfaces 5E and 5F respectively, thus forming a continuous insulating barrier of tortuous path to the elements. There may also be provided at least one groove (6) for the installation of electrical wires or other utility lines. Referring now to FIG. 5, the end member (3) is a composite of 3 shorter members (3') connected via finger joints in such a way as to connect the one short member with one grain direction to another short member with the grain direction being different than the adjacent member. This prevents warpage of the members in use in the panel units.

As many changes can be made to the invention without departing from the scope of the invention, it is intended that all material contained herein be interpreted as illustrative of the invention and not in a limiting sense.

The embodiments of the invention in which an exclusive property or privilege is claimed are as follows:

1. A panel having two ends and two sides, the panel having a peripheral frame and having at the sides thereof a first surface and a second surface separated by a predetermined distance, the predetermined distance extending from end to end of the panel; the panel having non opposing studs located proximate the first and second surfaces separated by a predetermined distance, said studs of said first surface being offset or staggered laterally a predetermined distance from said studs proximate said second surface; and insulating means having two ends and two sides located proximate the surfaces extending within the peripheral frame between the first and second surfaces with the studs embedded in the surfaces; said insulating means extending to each end of the panel, whereby the panel is rigidified by the lateral staggering of the studs; a joint proximate each end of the panel for interconnecting adjacent panels, the joint comprising some of the insulating means and some of the frame, wherein the side of said stud member extends a predetermined distance beyond the end of the insulating means to form a stepped interlocking joint the joint extending from top to bottom of each panel and ends thereof.

2. The panel of claim 1, wherein the staggered studs are embedded in the first and second surfaces of said insulating means.

3. The panel of claim 1 or 2 wherein the panel has upper and lower frame members, and proximate the end of the upper and lower frame members one side of the frame member extends a predetermined distance beyond the opposite side of said frame member forming a recess, whereby abutting ends of interconnected panels engage to form a true fit.

4. A panel of claim 1 or 2 wherein the studs are a composite of at least two members with grain directions of each member being substantially angled to one another, and said members being interlocked.

5. A panel of claim 3 wherein the studs are a composite of at least two members with grain directions of each member being substantially angled to one another, and said members being interlocked.

6. A panel system comprising at least two panels, of claim 1 or 2, engaged end to end whereby the end portions of the insulating means are engaged such that a continuous insulating barrier is provided resulting in a tortuous path to the elements.

7. A panel system comprising at least two panels, of claim 3, engaged end to end whereby the end portions of the insulating means are engaged such that a continuous insulating barrier is provided resulting in a tortuous path to the elements.

8. The panel of claim 1 or 2 wherein the joint means is stepped interlocking joint.

9. The panel of claim 3 wherein the joint means is a double stepped interlocking joint.

10. The panel of claim 1 or 2 where said insulating means comprises a foam portion.

11. The panel of claim 3 where said insulating means comprises a foam portion.

12. The panel of claim 3 where said recess is in the form of an "L".

13. The panel of claim 3 where said recess is in the form of an "L".

14. A panel system of claim 4 where said members are interlocked via a finger joint.

* * * * *